US008200105B2

(12) United States Patent
Matsushita et al.

(10) Patent No.: US 8,200,105 B2
(45) Date of Patent: Jun. 12, 2012

(54) FIRST STAGE TRANSFER BIAS OF AN IMAGE FORMING DEVICE

(75) Inventors: Makoto Matsushita, Osaka (JP); Yoshie Tsuchida, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 685 days.

(21) Appl. No.: 12/193,892

(22) Filed: Aug. 19, 2008

(65) Prior Publication Data

US 2009/0060540 A1 Mar. 5, 2009

(30) Foreign Application Priority Data

Aug. 31, 2007 (JP) ..... 2007-226216
Nov. 15, 2007 (JP) ..... 2007-296602

(51) Int. Cl.
*G03G 15/00* (2006.01)

(52) U.S. Cl. ..... 399/45; 399/66
(58) Field of Classification Search ..... 99/45, 66; 993/45, 66; 399/45, 66
See application file for complete search history.

(56) References Cited

U.S. PATENT DOCUMENTS 6,327,445 B1 * 12/2001 Honda et al. ..... 399/45
6,477,339 B1 * 11/2002 Yano et al. ..... 399/66
2006/0127115 A1 * 6/2006 Iwasaki et al. ..... 399/66
2006/0210326 A1 9/2006 Takehara et al.
2008/0181636 A1 * 7/2008 Izumi ..... 399/44

FOREIGN PATENT DOCUMENTS

| | | |
|---|---|---|
| JP | 2000-293055 | 10/2000 |
| JP | 2003-316091 | 11/2003 |
| JP | 2005-49891 | 2/2005 |
| JP | 2006-195143 | 7/2006 |
| JP | 2007-193000 | 8/2007 |
| WO | WO 02/056119 | 7/2002 |

OTHER PUBLICATIONS

Office Action issued Jan. 17, 2012 in Japanese Patent Application No. 2007-296602 filed Nov. 15, 2007.

* cited by examiner

*Primary Examiner* — David Gray
*Assistant Examiner* — Roy Y Yi
(74) *Attorney, Agent, or Firm* — Oblon, Spivak, McClelland, Maier & Neustadt, L.L.P.

(57) ABSTRACT

An intermediate transfer tandem type image forming device which has multiple first stage transfer units set parallel and a single power unit which simultaneously applies bias to the multiple first stage transfer units. When executing successive printing or both-sides printing and there is a need to change the bias value of the first stage transfer bias due to a mix of multiple types of recording media, the device is able to hold down electricity consumption, sustain image quality, and form images productively. When executing successive printing or both-sides printing, the application timing of the changed transfer bias due to the detection of a different recording medium to that of the initial medium is placed after the previous first stage transfer of a final color toner image is completed.

16 Claims, 14 Drawing Sheets

FIRST STAGE TRANSFER BIAS OF AN IMAGE FORMING DEVICE

BACKGROUND OF THE INVENTION

1. Field of the Invention

The present invention generally relates to image forming devices, and more specifically to an image forming device which executes control of the first stage transfer process of an intermediate transfer body to improve the image quality of copying machines, printers, facsimile devices, and multifunction devices which employ electrophotographic methods.

2. Description of the Related Art

Conventionally, image forming devices employ electrophotographic methods to form toner images one of each color consecutively with corresponding image support bodies. Upon the intermediate transfer body, which moves in a treadmill motion, the color images are superposed one onto the other and the first stage transfer image formed upon a intermediate transfer body is transferred to the target transfer body or recording medium (transfer material, paper). More specifically, the transfer process of an intermediate transfer unit is comprised of a first stage transfer process which develops the electrostatic latent image with toner on the image support body and transfers the toner image to the intermediate transfer body, and a second stage transfer process which transfers the toner image transferred on to the intermediate transfer body to the recording medium; and after these transfer processes a fixation process bonds the toner image to the recording medium.

Due to there being two processes, the first stage transfer process and the second stage transfer process, the electrically charged toner image is susceptible to damage by mechanical or electrostatic means. Specifically in the first stage transfer, when passing each station, a discharge occurs in the minute air gap between the intermediate transfer body and the image support body, and due to the discharge the electrical charge quantity distribution of the toner held by the intermediate transfer body broadens. Toner that becomes charged up, neutralized, or of the same polarity is realized and if the second stage transfer to the recording medium is executed with the existence of such toner, toner which cannot be electrostatically transferred to the recording medium remains upon the intermediate transfer body, and an image deficiency or a so called "bosotsuki" image occurs. Specifically, when using a recording medium with large surface roughness such as discharge-prone recycled paper the electrostatic attraction of toner is difficult, and due to pressure distribution being spotty the mechanical binding of toner with a small electrical charge quantity is difficult as well.

To prevent "bosotsuki" images occurring, for example, Japanese Laid-Open Patent Application 2000-293055 discloses detecting the recording medium that is to be used in the second stage transfer of the toner image and depending upon the type of the recording medium switching the strength of the first stage transfer bias of the first stage transfer unit.

To increase productivity, when executing successive printing or both-sides printing, the intervening spaces between images are sometimes narrowed to a size smaller than those of the spaces between the image support bodies of a four tandem structure. Also when applying a first stage transfer bias, as means to hold down electricity consumption and achieve desired downsizing, the integration of the power sources of the four color image support bodies which power sources apply the same bias is known.

Assume the structure of the device disclosed in Japanese Laid-Open Patent Application 2000-293055, which presuppose the use of a revolving structure, is applied to the four tandem structure and successive multiple color images are printed. The start timing of the first stage transfer of the N+1 page recording medium is at a timing while the first stage transfer of the N page recording medium is in progress. If there were a mixture of various types of recording media so that the paper quality changes, in a machine type which simultaneously applies bias to multiple first stage transfer units, electrical noise occurs if the first stage transfer bias value of the N page recording medium is changed to the first stage transfer bias value of the N+1 page recording medium (in a case where the toner image straddles stations before or after the change to the bias) and dissatisfaction with the image quality results.

SUMMARY OF THE INVENTION

Accordingly, embodiments of the present invention may provide a novel and useful image forming device solving one or more of the problems discussed above.

More specifically, the embodiments of the present invention may provide an intermediate transfer method tandem type image forming device that executes successive printing or printing both sides with multiple first stage transfer units in parallel; and despite a need to change the bias value of the first stage transfer bias such as when there is a mix of multiple types of recording media, holds down electrical consumption, retains image quality, and forms images productively.

One aspect of the present invention may be to provide a tandem type image forming device comprising a single power source that simultaneously applies bias to multiple first stage transfer units, wherein the device detects the recording medium for final image information transfer, and according to the type of recording medium, controls the first stage transfer bias and transfers the toner image to the intermediate transfer body from multiple image support bodies. When executing successive printing or both-sides printing, the application timing of the transfer bias that changes due to the detection of a different recording medium from the initially detected recording medium is placed after the first stage transfer of the final color toner image, thereby resolving the application timing.

In the image forming device according to an embodiment of the present invention, it may be preferable to have the first stage transfer bias apply an appropriate bias value lower than that of normal paper when the recording medium is identified as a rough surface paper type. It may be preferable to determine the type of the recording medium with the paper type detection means or from driver information from the user. When changing the transfer bias according to the detected recording medium, it may be preferable to give consideration to the information from image forming stations of each color or the first image forming station which executes the first stage transfer to the intermediate transfer body. Within the image forming information, there are information items pertaining to toner consumption quantity calculated from data such as printing rate and the remaining toner quantity from the toner concentration sensor. Particularly significant is information calculated from the rotational speed of the motor driving the cartridge, for example, the running distance of the rotating bodies within the image forming station or the running distance of the development roller within the image forming station. It may be preferable to have the same first stage transfer bias for multiple first stage transfer units. It may be preferable for the surface resistivity of the belt, which is the intermediate transfer body, to be in a range $1.00\times10^{7}$~$1.00\times10^{12}$ $\Omega/cm^2$. It may be preferable to place the write-timing to the image support body at a point after the facing section of the image support body, where the control bias is changed according to detected recording medium, passes the exposure position. It may be preferable to introduce elements of temporal adjustment and usage environment adjustment to bias change.

In the image forming device according to an embodiment of the present invention, when executing successive printing or both-sides printing, the application timing of the changed control bias according to the detection of a different type of recording medium from that of the initial recording medium is placed after the first stage transfer of the final color toner image; thus transfer noise related to the bosotsuki effect does not occur. Also, even with the use of an intermediate transfer body of a thermo-reversible resin which has a strong voltage dependency, slow charge decay, and a relatively high chance of an afterimage occurring, decline in image quality is not seen and thus cost can be held down. When there is a mix of different types of recording media during successive printing or both-sides printing, the setting of the first stage transfer bias after completion of the prior job every time the type is detected to be different or the transition to the next job becomes time consuming and results in productivity decline. According to an embodiment of the present invention the changed bias may be applied at a timing after the first stage transfer of the final color toner image, thereby avoiding a significant loss of productivity.

Other objects, features, and advantages of the present invention will become more apparent from the following detailed description when read in conjunction with the accompanying drawings.

DETAILED DESCRIPTION OF THE PREFERRED EMBODIMENTS

A description is given below, with reference to the FIG. 1 through FIG. 12 of embodiments of the present invention.

Figure 1:
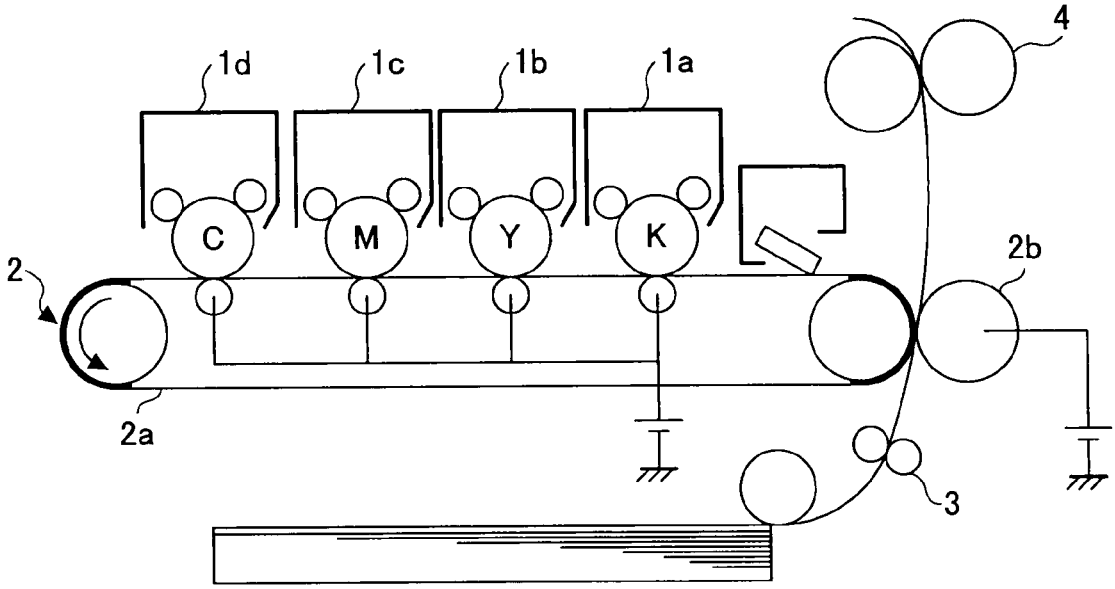
FIG. 1 is a schematic diagram illustrating an overview of example 1 of an embodiment of the present invention.

Shown in FIG. 1 is an image forming device of an embodiment of the present invention with a so called one-pass transfer four tandem structure. In the mechanical device there are four image forming stations 1 with color order black (K), yellow (Y), magenta (M), and cyan (C). According to this example, image forming stations 1 of the corresponding colors are structured as process cartridges 1. The process cartridges 1 are each comprised of at least an image support body and a development roller as a developing unit and are detachable from the image forming device. The structure and action of the process cartridge is well known in the art wherein, a non-magnetic single component toner is used, the developing unit conveys the toner by frictional electrification, and forms an image by applying a bias in between the image support body which has formed an electrostatic latent image and the developing roller. It is structured to hold down cost by applying the same bias to each process cartridge but upon application of a first stage bias the bias value is set depending upon the type of paper of a recording medium onto which the image is to be transferred. The detection of the type of paper of the recording medium is done by detection of the electric current of the recording medium before a second stage transfer or by a transmission sensor, though it is not limited to this. The use of these detection means for the detection of the type of paper resolves the inconvenience of selection by the user. Also the toner type is not limited to a non-magnetic single component toner but may be a two-component toner or a positive charged toner as well, and the colors of the process cartridges may be in any order. At a transfer device 2 the single color toner images formed by the corresponding process cartridges' are superposed one onto the other to arrive at an intermediate transfer component 2*a*, and afterward at a second stage transfer component 2*b* the superposed image is transferred to the recording medium conveyed by paper-stop rollers 3 gauging the timing. For image formation upon one side, a fixation device 4 bonds the superposed color image to the recording medium and ejects it. For image formation upon both sides, after running through a both-sides printing paper inversion route (not shown in the figures) the recording medium is conveyed to the upstream side of the paper-stop rollers 3 and an image is formed on the back-side.

Figure 2A:
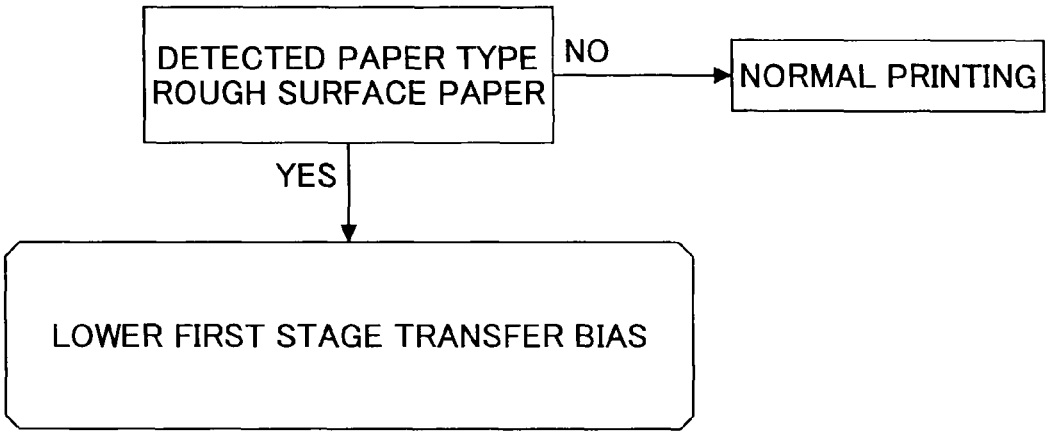
FIG. 2 is a diagram illustrating various bias sequences that determine whether to lower the first stage transfer bias.
Figure 2B:
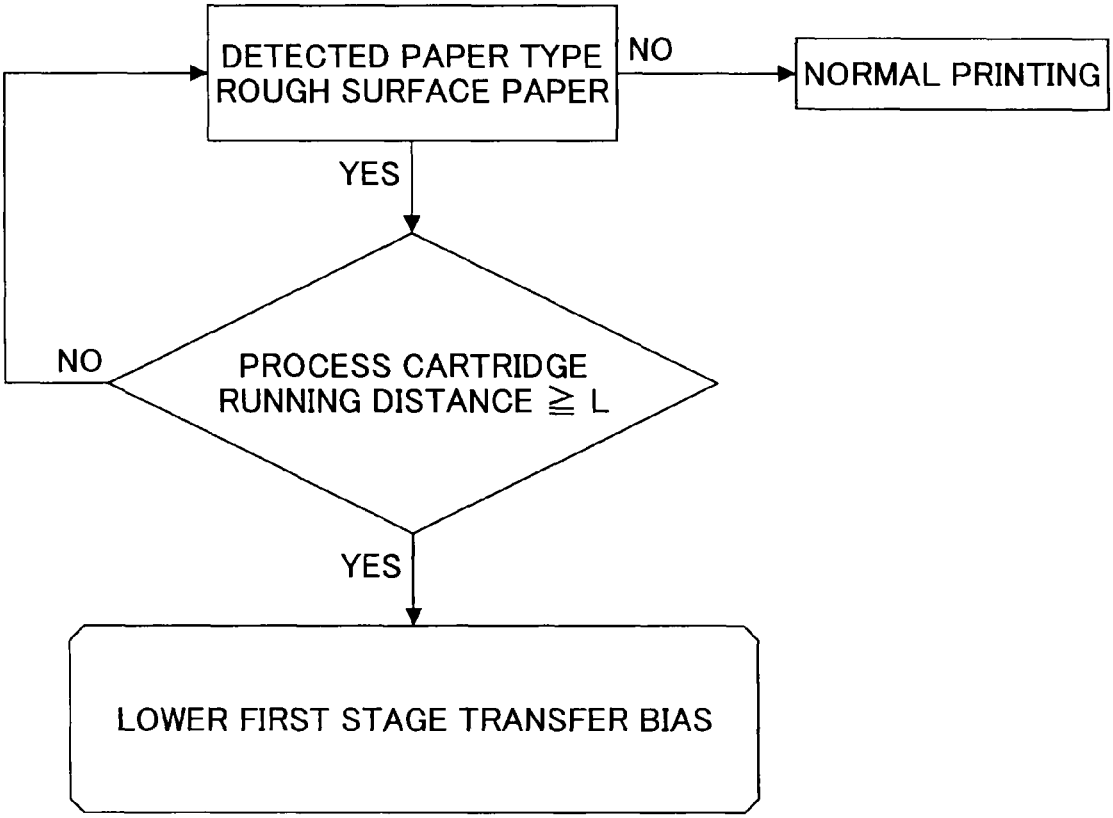
Figure 2C:
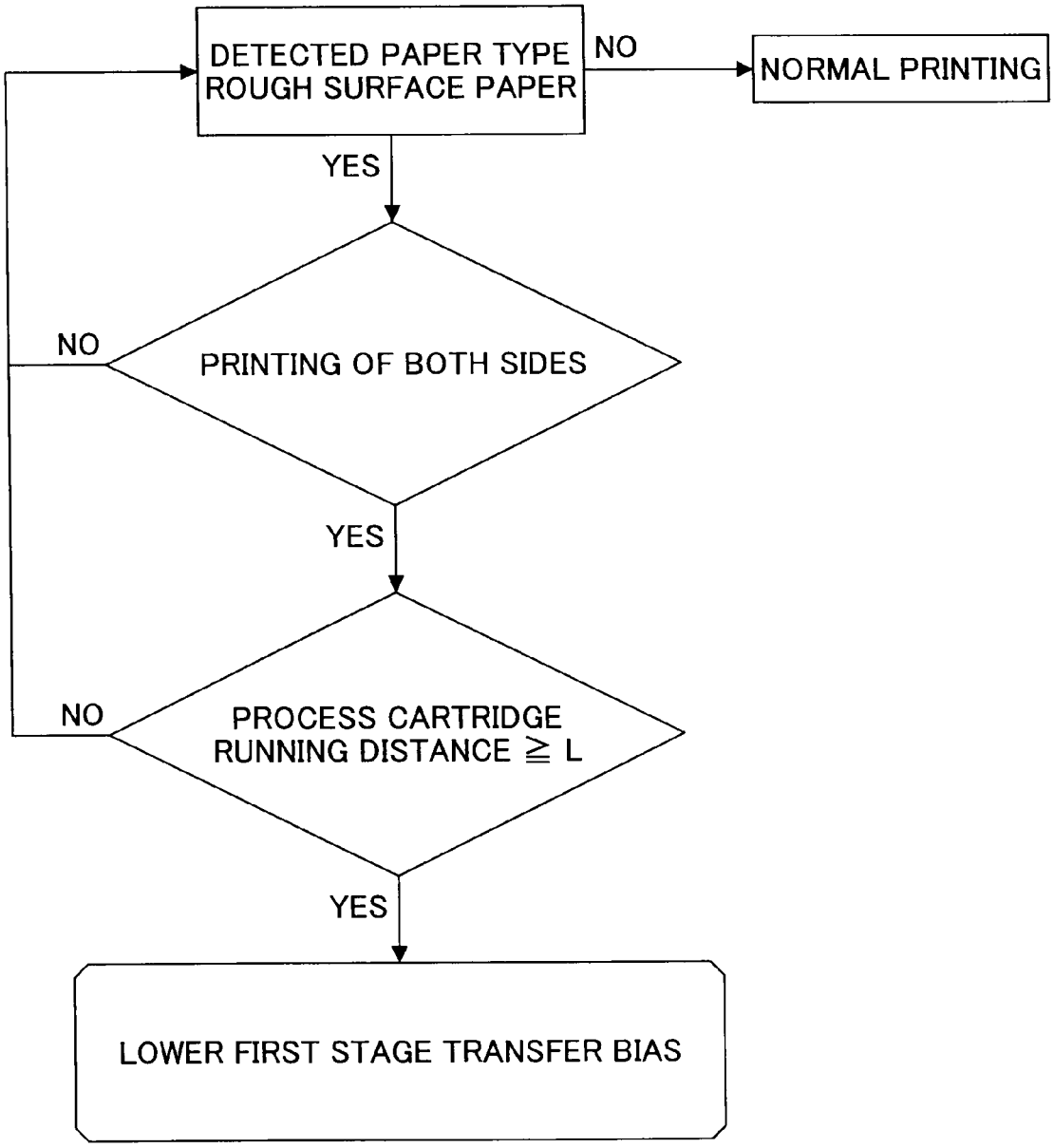
Figure 2D:
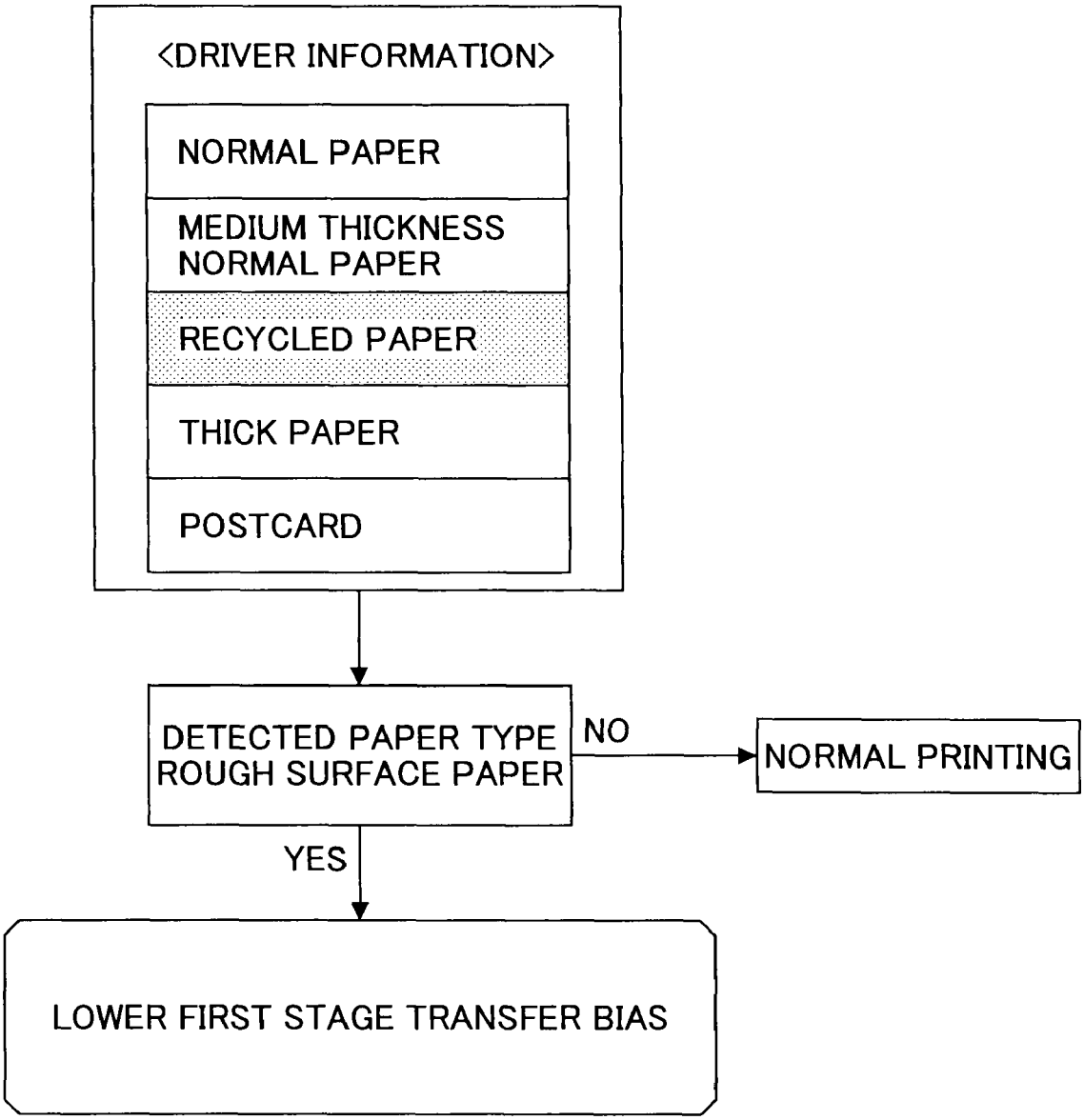
Figure 3:
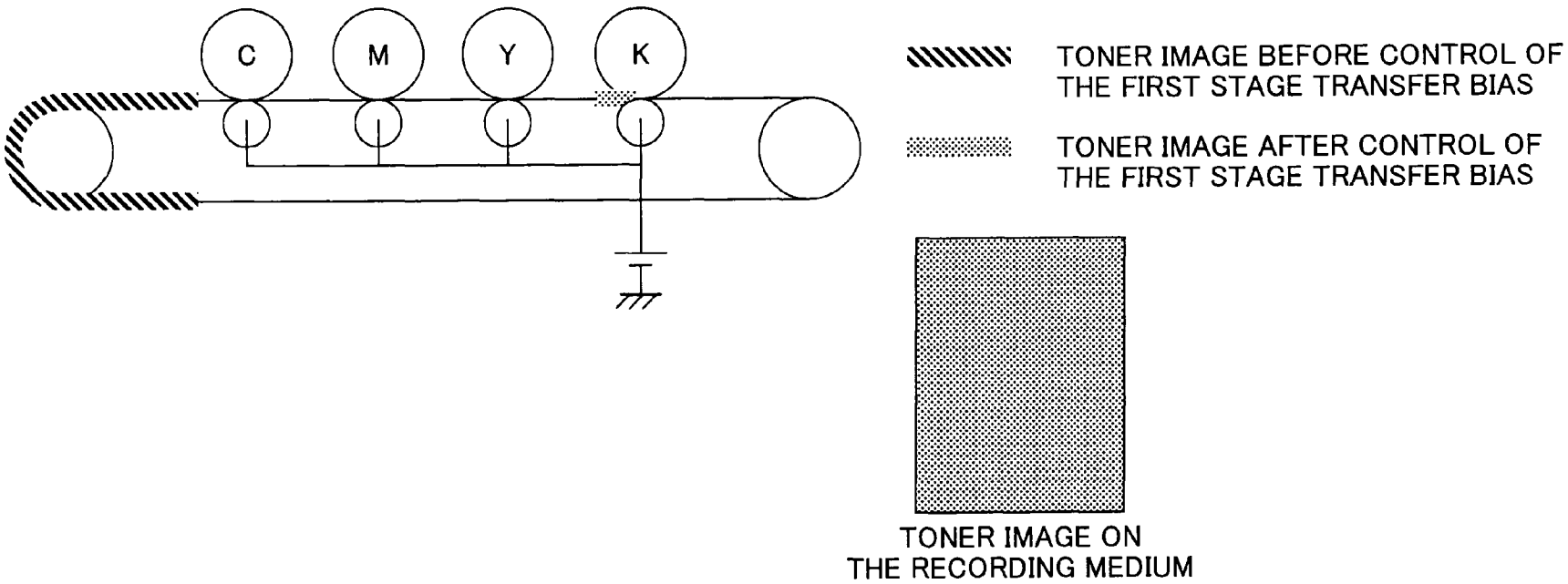
FIG. 3 is a diagram illustrating the application timing of the bias in the process of the first stage transfer of the toner image, which is applied at a location after the preceding toner image has passed the final color.

As mentioned above, the paper type of the recording medium is detected by detecting the electric current of the recording medium before the second stage transfer or by a transmission sensor and as a result of the detected paper type, for example, if the detected paper surface is rougher than the initially set smooth surface paper such as regular paper, the first stage transfer bias is lowered. By lowering the bias value, the bosotsuki effect and wasteful discharge are restrained and transfer efficiency is improved resulting in holding down the cost per page. To recognize differing types of recording media, for example, limiting smoothness with the Bekk method (JIS-P8119) is an option, in which any recording medium (My recycle paper, Classic White, Nautilus, and such) under 50 s is classified as rough surface paper. Smoothness and type recognition are not limited to this. Shown in FIG. 2 are various types of bias sequences when it is determined to lower the first stage transfer bias. In FIG. 2B a flowchart shows the running distance (calculated from the rotational frequency of the motor driving the cartridge) of the process cartridge, and whether it is above or below a predetermined value L is included as a decision factor/criterion. According to research, the calculated rotational frequency of the motor driving the process cartridge is significant information related to image quality decline and therefore setting the sum of the running distance of the rotating body within the process cartridge as a standard, which markedly reflects the extent of toner degradation, prevents image quality degradation. In FIG. 2C is a flowchart showing that, other than the running distance of the process cartridge, whether there is both-sides printing is included as a decision factor/criterion. This is due to there being seen a further decline in image quality when both-sides printing is executed. Shown in FIG. 2D is a flowchart containing driver information from the user. This is when there is a paper selection mode on the printing window of a personal computer of the user wherein based upon the selected information of the user, the paper type is identified; this method realizes a simple detection without cost.

Figure 4:
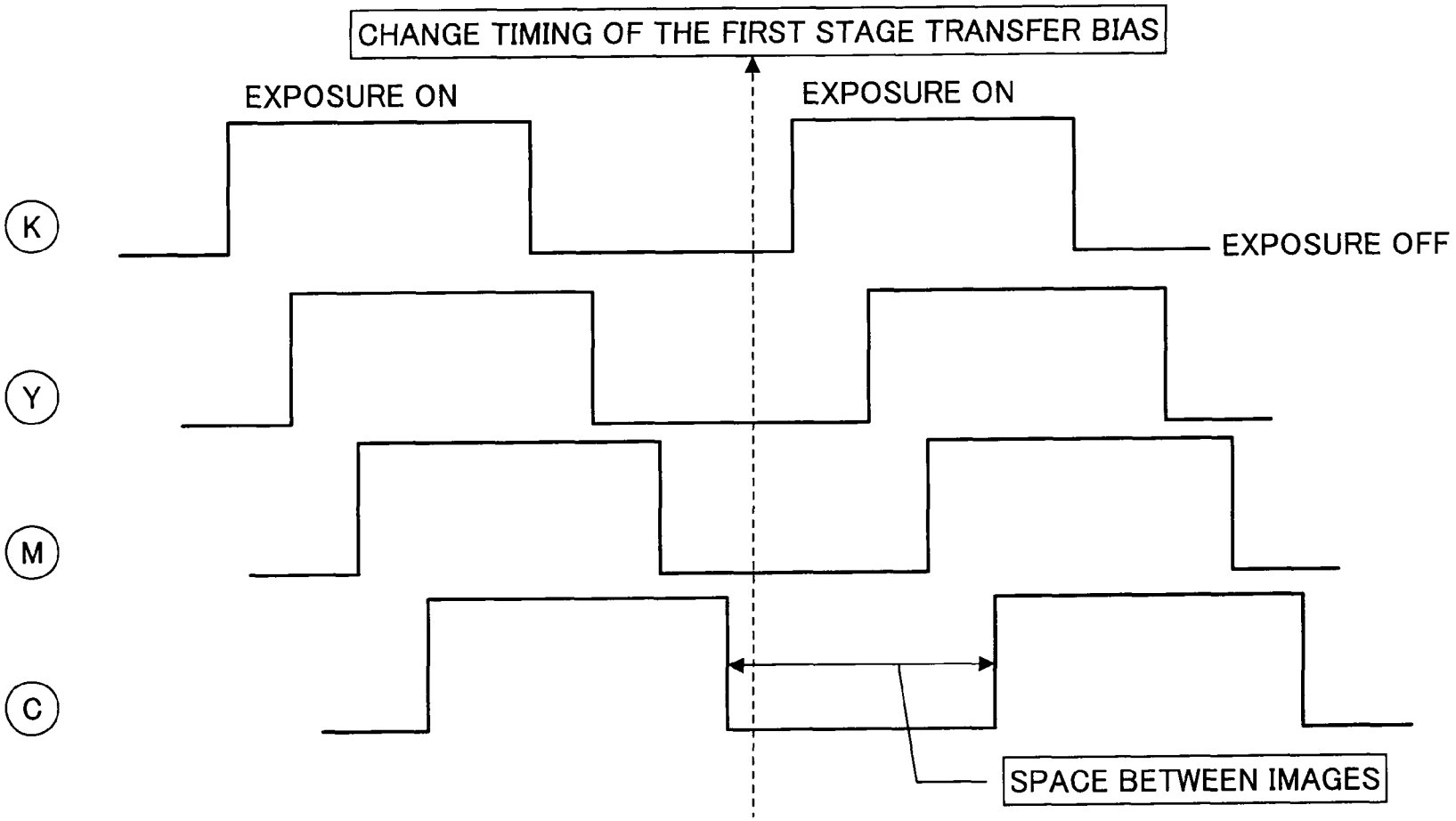
FIG. 4 is a timing chart illustrating the change to the timing of bias application in an embodiment of the present invention.

In the following the timing to control the transfer bias is based upon the detected paper type. Shown in FIG. 3 (example 1) is a situation when the recording medium (Classic White; STEINBEIS made) is detected as being a rough surface paper and control is necessary, where the timing of the bias application is placed after the preceding toner image has passed the final color (cyan). More specifically, at the point when the controlled transfer bias is applied to the black color, there is no toner image at the first stage transfer sections of the other colors positioned downstream in the recording medium conveying direction. The image to be printed here is a halftone image. Usually the first stage transfer bias is 700 V in a normal paper mode and in this example the prior toner image has been transferred to the intermediate transfer body at the first stage transfer with 700 V. At the point where the recording medium is recognized as being recycled paper (rough surface paper) and there arises a need to change the first stage transfer bias, a first stage transfer bias of 600 V is applied. Shown in FIG. 4 is the timing chart of this situation. Note that the first and second stage transfer biases are a reversed polarity in contrast to the toner.

Figure 5:
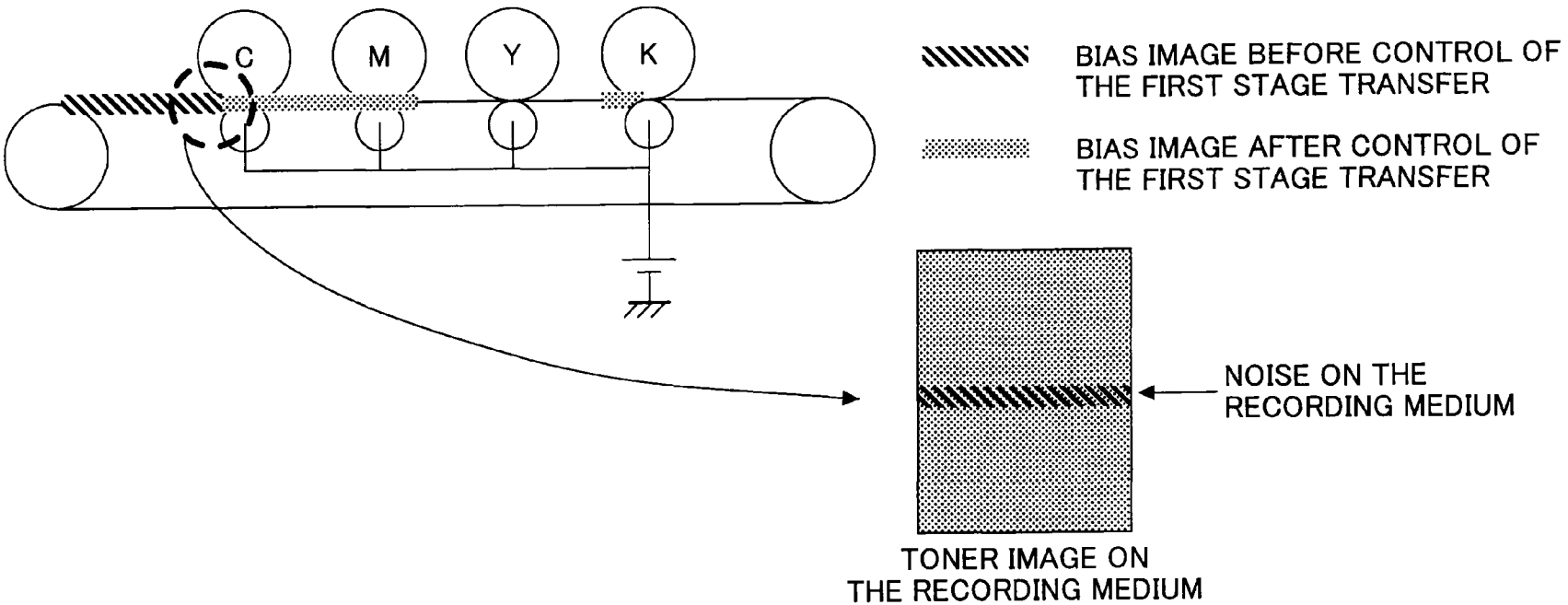
FIG. 5 is a diagram illustrating the change to the bias before the preceding first stage transfer of a cyan toner image on the intermediate transfer belt is completed.
Figure 6:
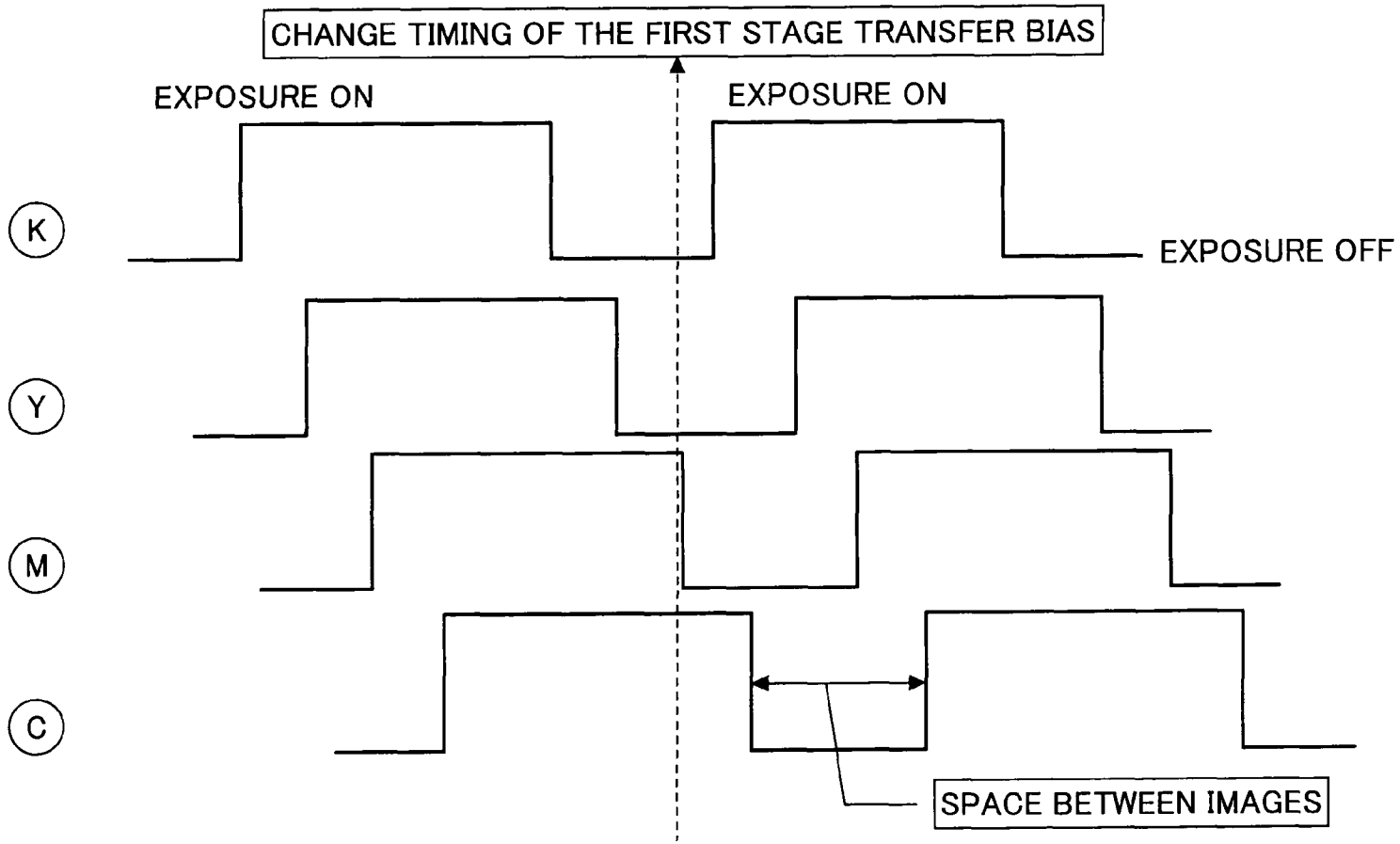
FIG. 6 is a timing chart corresponding to FIG. 5.

In FIG. 5 (comparison example 1) the bias was changed before completion of the first stage transfer of the final color (cyan) of the preceding toner image upon the intermediate transfer component. Identical to the above case, the printing was of a halftone image, the bias application of the preceding toner image was 700 V, and after recognition of the recording medium as being recycled paper (rough surface paper) a 600 V first stage transfer bias was applied. As a result, at the timing where the first stage transfer bias was applied there appeared a contrasting-shading section on the halftone image and by reason of this image noise, image quality was unsatisfactory. Shown in FIG. 6 is the timing chart of this situation. Note that at the larger differences in bias change noise appeared at time of application.

CHART 1

| | | AFTER FIRST STAGE TRANSFER CONTROL (THE POTENTIAL DIFFERENCE V BEFORE CONTROL) | | | | | |
|---|---|---|---|---|---|---|---|
| | | −10 | −50 | −100 | −150 | −200 | −250 |
| EXAMPLE | HALFTONE NOISE | ○ | ○ | ○ | ○ | ○ | Δ |
| | BOSOTSUKI | X | X | ○ | ○ | ○ | ○ |
| COMPARISON EXAMPLE 1 | HALFTONE NOISE | ○ | ○ | X | X | X | X |
| | BOSOTSUKI | X | X | ○ | ○ | ○ | ○ |

○: NO DIFFERENCE CAN BE OBSERVED WITH VISUAL EVALUATION
Δ: NOISE OBSERVED ON IMAGE WITH VISUAL EVALUATION THOUGH IS AT A TOLERABLE LEVEL
X: NOISE CLEARLY OBSERVED WITH VISUAL EVALUATION

Shown in chart 1 is a contrasting-shading image noise level and bosotsuki evaluation due to bias application timing in a halftone image, in a situation where the applied control bias value in contrast to the first stage transfer bias value in a normal paper mode was lowered 10 V~250 V. Not much difference could be seen in −10 V~−50 V though noise markedly stood out beyond a bias of −100 V.

Figure 7:
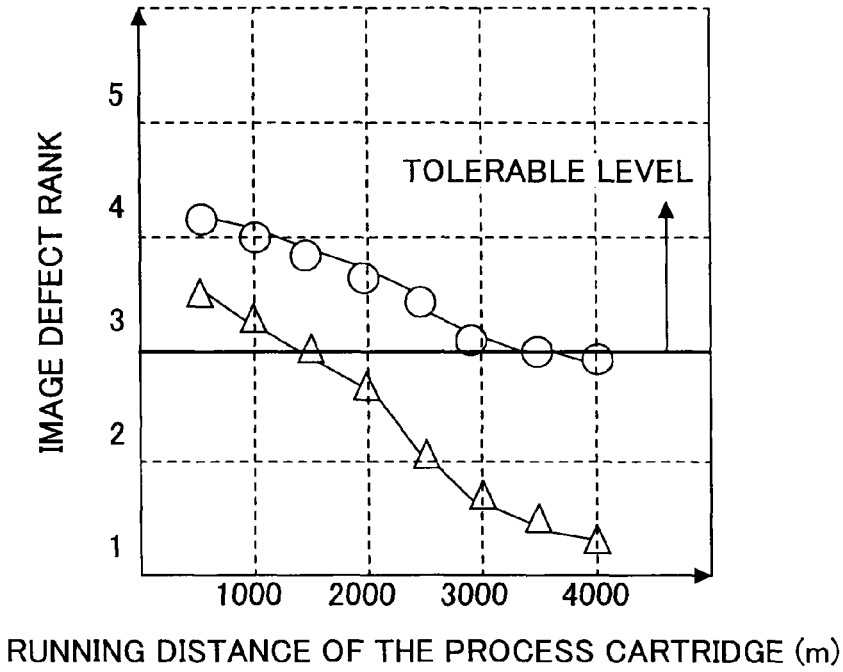
FIG. 7 is a graph illustrating the first stage transfer bias with control and without control compared to the running distance of a cartridge.

In the bias sequence shown in FIG. 2, when the first stage transfer bias is determined to be lowered due to the type of recording medium, there are control methods which take into consideration the running distance of the process cartridges (FIGS. 2B, 2C). Inside the process cartridges there are many parts that rotate such as a photoreceptor (image support body), the development roller, and a feeding roller, which are often rotating with different linear velocities in respect to each other. Information which shows notable image quality decline is calculated based on the rotational frequency of the motor driving the cartridge. Thus by setting the sum of the running distances of the rotating bodies as the standard, which markedly reflects the extent of toner degradation, prevention of image quality degradation is possible. Within this information, information of the development roller is especially focused upon because the running distance of this roller is most linked to image quality. Basically, toner degradation occurs due to the rubbing friction of the toner within the cartridge, inducing the degradation of the developer, and in turn reflecting the status of the toner. Degraded toner markedly shows on rough surface paper such as recycled paper, thus the final image and the type of paper are related. FIG. 7 is a graph showing where the control of the first stage transfer bias is executed according to the cumulative running distance of the process cartridge for printing ranging from normal paper to rough surface paper by ○ marks 680 V for 0~1000 m, 780 V for 1000~2500 m, 830 V for above 2500 m, and if temporal adjustment is added a control of lowering 100 V for each is executed. The condition where the running distance of the process cartridge is excluded from the control parameter is shown by Δ marks. Thus, it can be seen that by controlling the first stage transfer bias with the running distance information of the process cartridge the tolerable image level can be sustained.

In FIG. 7, the first stage transfer bias is changed from 700 V to 600 V when the paper type is recognized as being a rough surface paper compared to the initial normal paper; the reverse change to a higher bias (600 V→700 V) is executed when the paper type recognized as being a rough surface paper is followed by normal paper. Also, the bias is lowered in a case of changing from normal paper to medium thick paper (700 V→600 V), the bias is increased in a case of changing from medium-thick paper to normal paper (600V→700V), the bias difference is relatively increased for changing from normal paper to thick paper/postcard (700 V→550 V), and the bias difference is relatively increased for changing from thick paper/postcard to normal paper (550 V→700 V).

Figure 8:
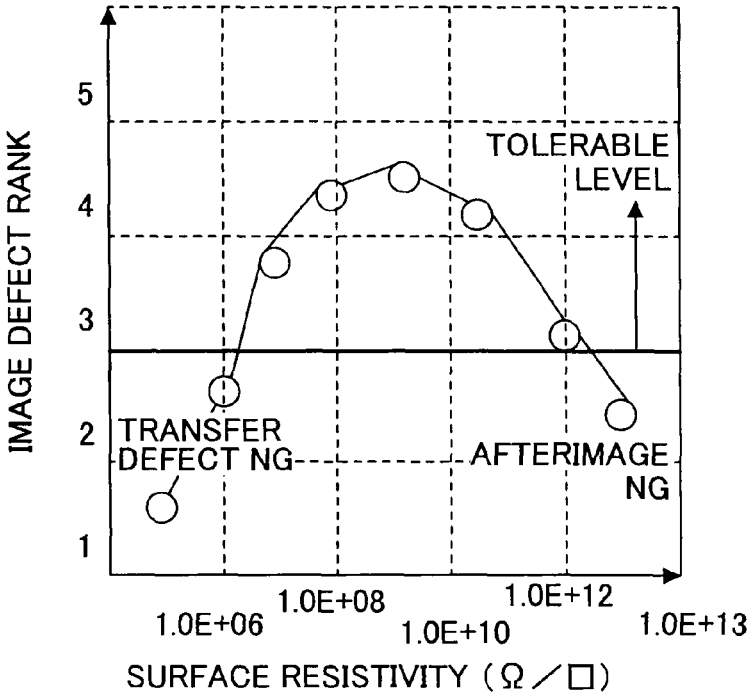
FIG. 8 is a graph illustrating the image noise rank compared to the surface resistivity of the intermediate transfer belt.

FIG. 8 is a graph of image noise to surface resistivity of the intermediate transfer belt, which indicates material with a surface resistivity to the $10^7$~$10^{12}$ Ω/cm$^2$ is preferable for the intermediate transfer component. The shown resistivity was acquired with a Yukadenshi Co. Ltd. made Hailesuta (URS probe) with 500 V applied for 10 seconds. When the first stage transfer bias is applied to the intermediate transfer belt and the electric-charge transfer quantity is excessive or too small an issue of a so-called "afterimage" arises, though this is also related to the charge decay and the resistance value of the intermediate transfer belt; to prevent image omission due to the electric potential memory the surface resistivity range of FIG. 8 is preferable. The low side is the bottom limit of suppressing discharge and the high side is the top limit of image noise due to the electric potential memory and cost for the use of a high-output power source.

Figure 9:
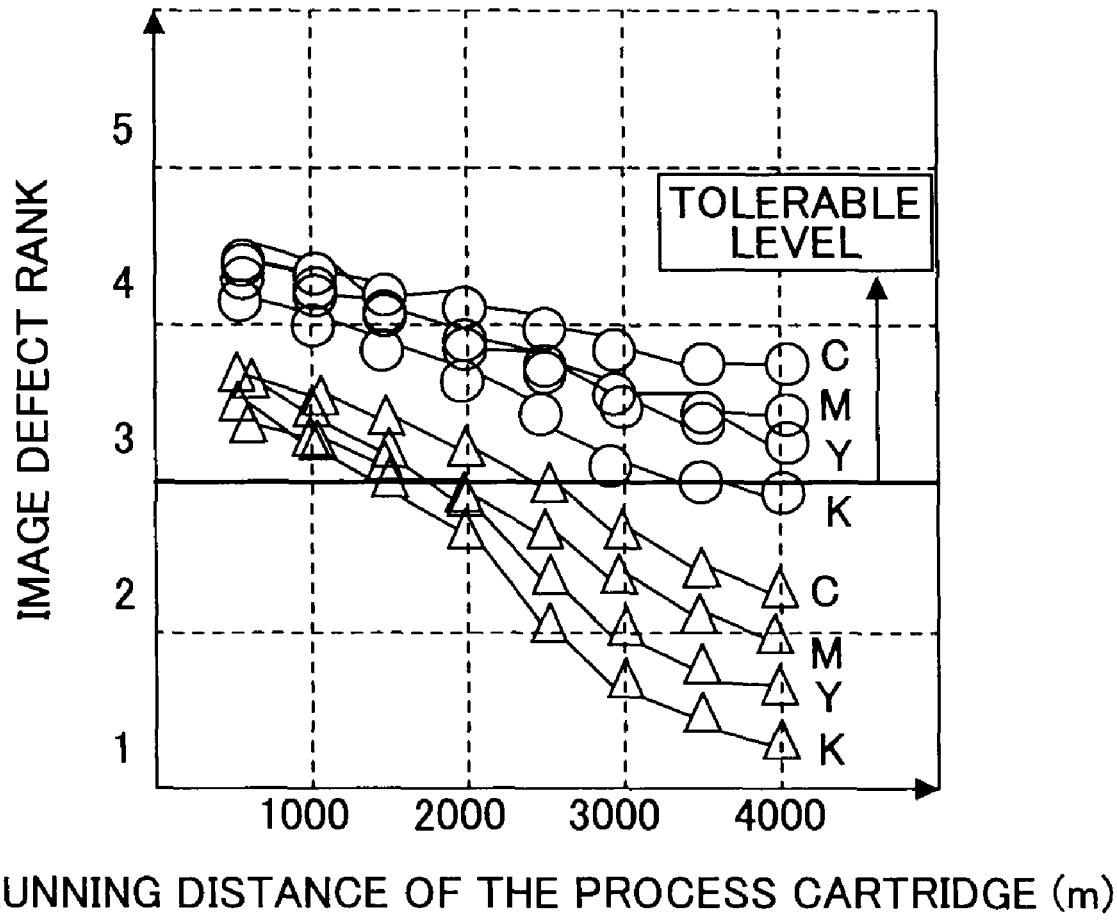
FIG. 9 is a graph illustrating the most upstream black color being the element which lowers the image rank the most in a case of K, Y, M, C color order.

When changing the control bias according to the detected recording medium, by taking into consideration the information of each process cartridge, the degradation of the cartridge or the degradation of the toner can be reflected and thus it is possible to experience no image quality loss even near the terminal stage of the process cartridge service life. FIG. 9 shows a situation where the cartridge color order is KYMC and when printing changes from normal to rough surface paper the process cartridge on the most upstream side, or the black color, drops the most in image rank. This indicates that the information of the black process cartridge is more effective for making adjustments (the running distance and the bias values are just examples 680 V for 0~1000 m, 780 V for 1000~2500 m, 830 V for over 2500 m and if temporal adjustment is included a control of lowering each 100 V is executed). Simply put, the first color (in this example, the color black) which executes the first stage transfer to the intermediate transfer body is the one which significantly decreases image quality and thus placing this as a standard can prevent image quality degradation.

Figure 10A:
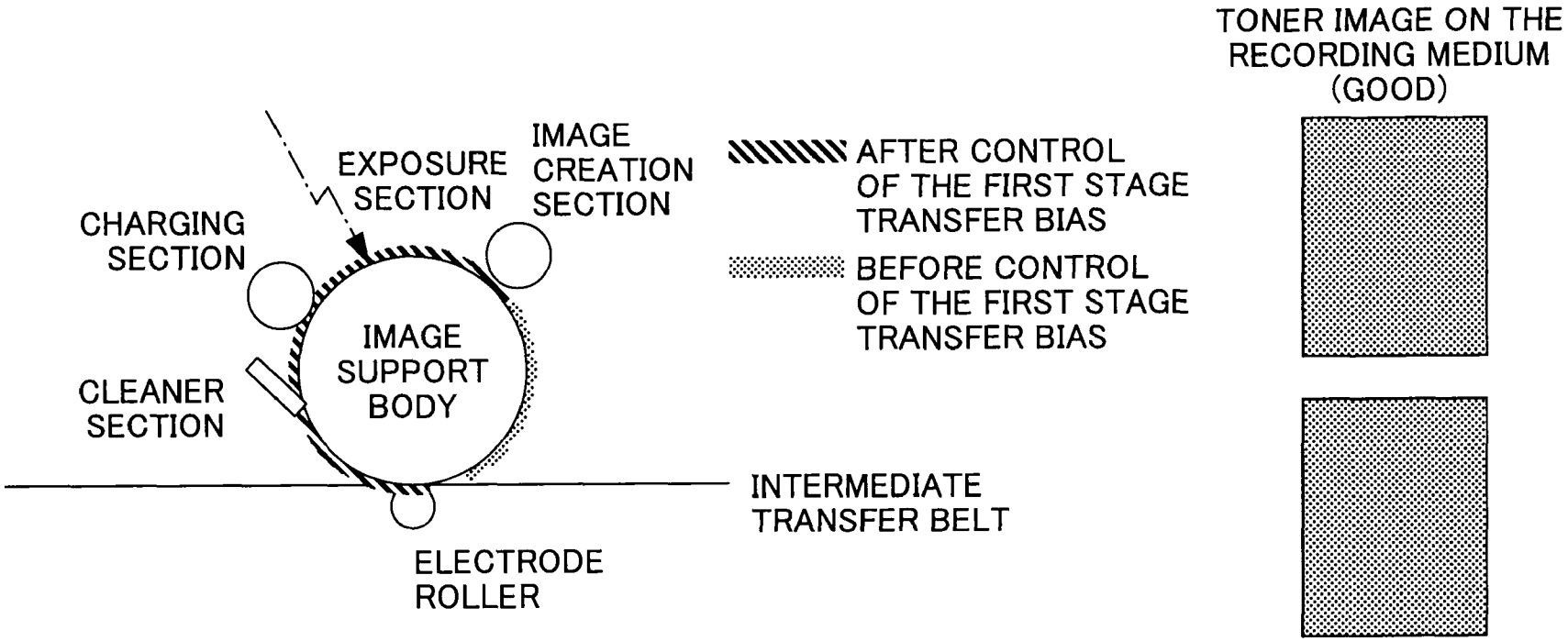
FIG. 10A illustrates writing after the changed bias application section has passed the exposure section, and FIG. 10B illustrating writing before the changed bias application section has passed the exposure section.
Figure 10B:
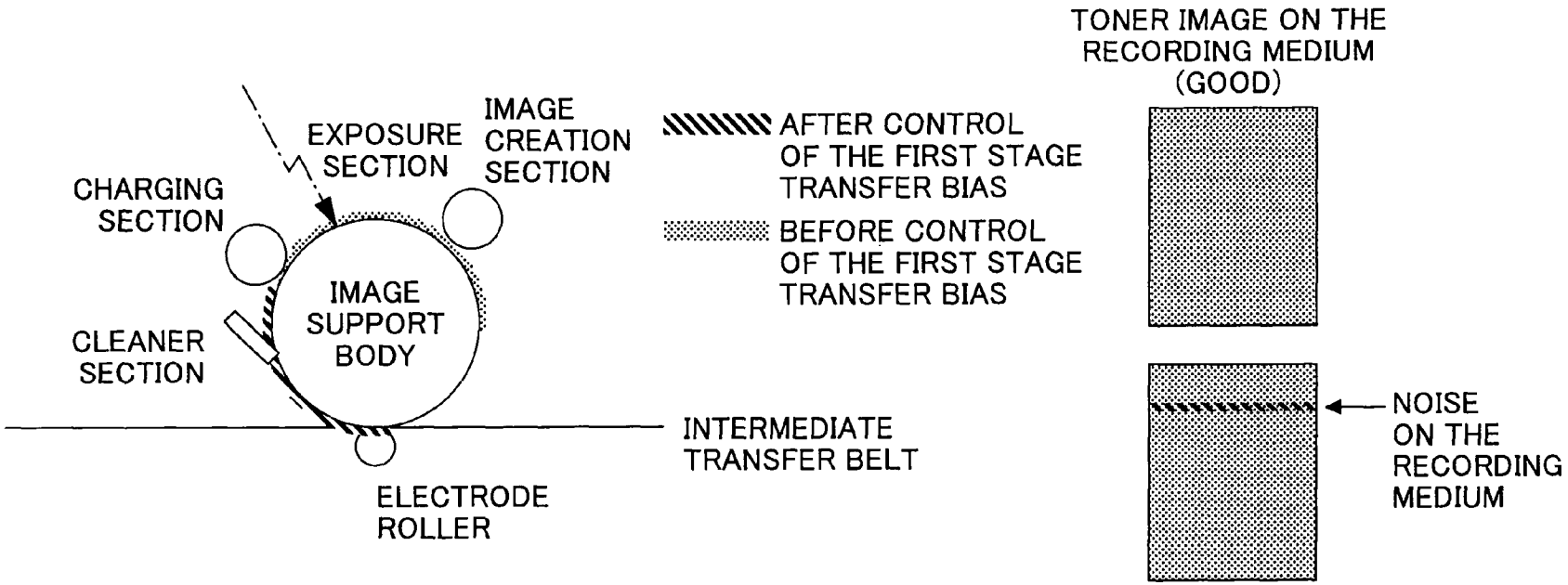
FIG. 10 illustrates the write timing to the image support body when changing the first stage transfer bias, where

In the following is an explanation of the write-timing for the image support body. The issue of afterimage is prominent in an OPC with no neutralization apparatus; when printing with a potential difference, contrasting-shading occurs upon the boundary or the location of bias change. According to the embodiment of the present invention, the first stage bias value is changed in accordance with the detected recording medium type and exposure and writing are executed after the bias value change position on the rotating image support body has passed the exposure point. This is shown in FIG. 10A. In this way, over-shooting or damage to the image support body which in turn cause image noise in the memory can be avoided. In contrast, in FIG. 10B, the execution of exposure and writing before the bias value change position is shown upon the rotating image support body passing the point of exposure. If according to the above principles, the first stage transfer bias value is lowered beyond a certain degree, marked contrasting-shading results in printing a halftone image.

CHART 2

| TONER CARTRIDGE SERVICE LIFE | | AFTER FIRST STAGE TRANSFER CONTROL (THE POTENTIAL DIFFERENCE V BEFORE CONTROL) | | | | | |
|---|---|---|---|---|---|---|---|
| TERMINAL STAGE | | −10 | −50 | −100 | −150 | −200 | −250 |
| EXAMPLE 2 | HALFTONE NOISE | ○ | ○ | ○ | ○ | ○ | Δ |
| | BOSOTSUKI | X | X | Δ | ○ | ○ | Δ |
| COMPARISON EXAMPLE 2 | HALFTONE NOISE | ○ | ○ | X | X | X | X |
| | BOSOTSUKI | X | X | Δ | ○ | ○ | Δ |

○: NO DIFFERENCE CAN BE OBSERVED WITH VISUAL EVALUATION
Δ: NOISE OBSERVED ON IMAGE WITH VISUAL EVALUATION THOUGH IS AT A TOLERABLE LEVEL
X: NOISE CLEARLY OBSERVED WITH VISUAL EVALUATION

In chart 2, example 2 shows the effectiveness against halftone noise and the bosotsuki effect by switching the first stage transfer bias value (−100 V) when the running distance of the process cartridge exceeds 2000 m and then writing after the bias value change position upon the image support body has passed the exposure point. As shown in comparison example 2, if the running distance of the process cartridge exceeds 2000 m and the bias value change position has not passed the exposure point, noise is likely to appear in a halftone image.

Figure 11:
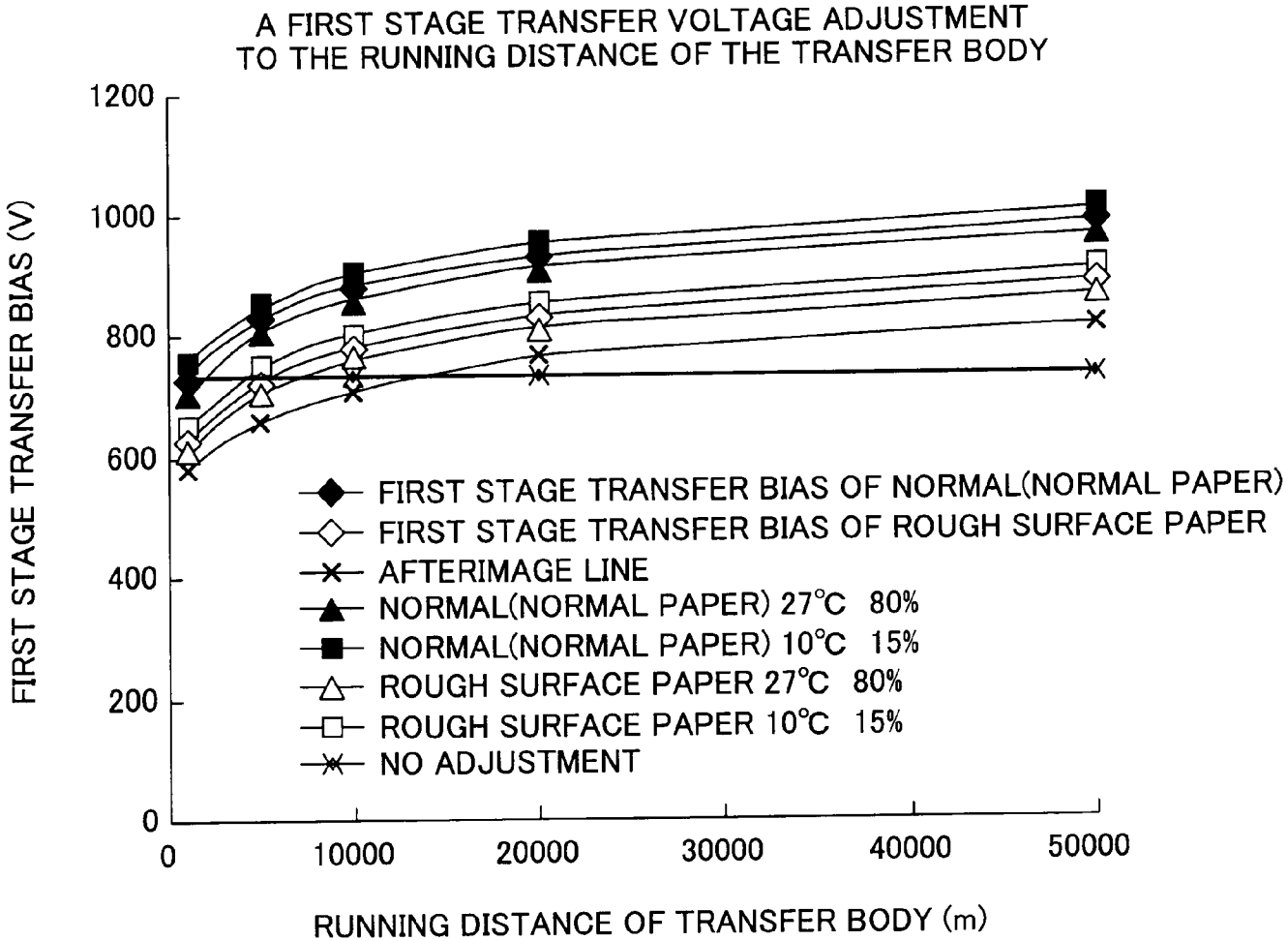
FIG. 11 is a graph illustrating the temporal adjustment and the usage environment adjustment upon changing the first stage transfer bias.

As the number of pages printed by the transfer body progresses, contamination accumulates on the back-side of the intermediate transfer body and on the electrodes, inducing conduction degradation or electrode failure; also due to conduction resistance increase, bias sometimes is not successfully applied, resulting in an afterimage. According to an embodiment of the present invention, to respond to conduction degradation and filming of the intermediate transfer component due to the increase of printing quantity, the image forming device is equipped with a temporal adjustment function to increase the predetermined control value of the first stage transfer bias. Thus transfer defects such as concentration decline in number. Shown in FIG. 11 is a condition where temporal adjustment is applied. The line falls below the afterimage line of the first stage transfer bias an afterimage occurs (below tolerance level). Also shown is a condition where adjustment is not applied. Afterimage occurs around where the running distance of the intermediate transfer body exceeds 10000 m and the non-adjusted line falls below the afterimage line. Also it is known that concentration changes depending upon the environment of use and thus to stabilize image quality an adjustment function for the environment of use is provided, thereby achieving stable images with little concentration change.

According to the above embodiment of the present invention, the image processing device has a single power unit applying a first stage transfer bias to the image forming station of each color. When executing successive printing or both-sides printing with this four-tandem device, even at times where the intervening spaces between the images are narrowed to a size less than that of the space between the image support bodies to increase productivity, when a different type of recording medium from the type of the initial recording medium is detected, the application timing of the control bias is changed after the execution of the first stage transfer of the preceding final color toner image before the control bias is changed, achieving a balance of image formation productivity and sustaining image quality. When using a single power unit, it is not possible to set the first stage transfer bias independently; thus when considering bias control based upon the information from the image forming station of each color, for example, there is a need to constrain the information to that of only the most upstream station. To resolve this constraint, based upon the information of the recording medium, independent control of the first stage transfer bias of each color is envisaged.

Figure 12:
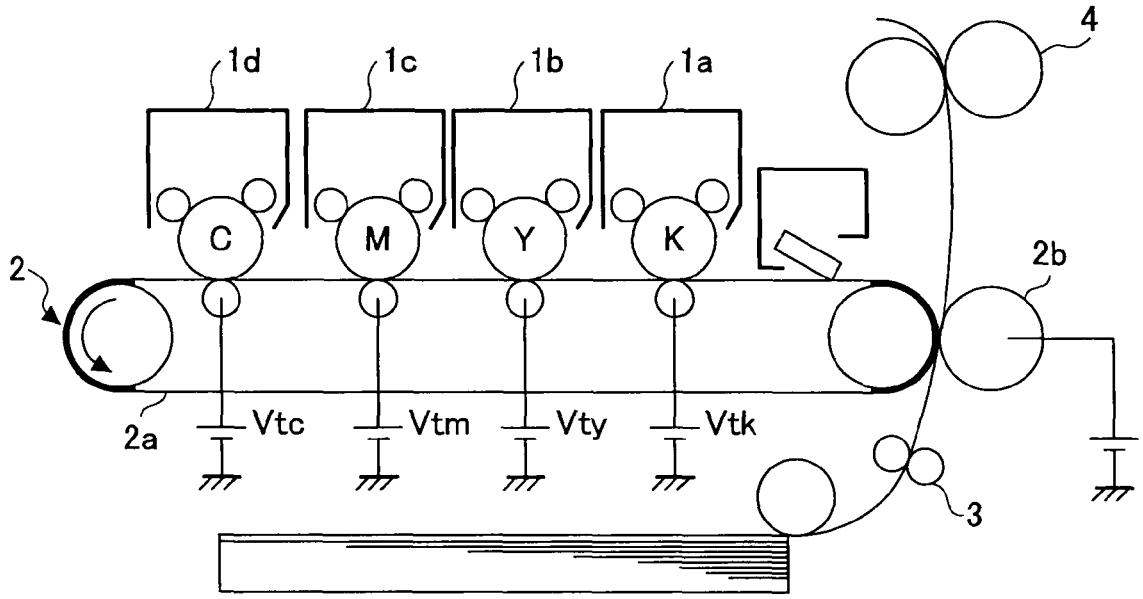
FIG. 12 is a schematic diagram illustrating an image forming device of an embodiment of the present invention equipped with independent power units for first stage transfer bias for the corresponding image forming stations.

Shown in FIG. 12 is an image forming device of example 3. Unlike the structure of FIG. 1, there are independent first stage transfer biases $V_{tk}$, $V_{ty}$, $V_{tm}$, and $V_{tc}$. The other parts are identical to FIG. 1 and thus to simplify the explanation, references to the general structure are not repeated and the following explains sections that are specific to example 3. For reference, the relationships shown in FIG. 2 through to FIG. 10 also apply to the application of the first stage transfer bias that is generated by independent power units. In FIG. 9 a bias voltage is applied in ranges 680 V for 0~1000 m, a 780 V for 1000~2500 m, and 830 V for over 2500 m. If temporal adjustment is included the bias is lowered 100 V for a single power unit but with independent power units the bias is lowered K: 100 V, Y: 110 V, M: 120 V, and C: 130 V. The reason the bias can be lowered more than 100 V for the downstream stations is that on the upstream side the bias is stronger and remains to some extent as an electric potential memory. Note that the running distance and bias value are just examples and not limitations; for example, lowering K:75 V, Y:100 V, M:125 V, and C:150 V is effective for image quality improvement and lowering K:50 V, Y:125 V, M:125 V, and C:125 V also produces similar results.

In the following chart 3 an example of lowering the first stage transfer bias when the running distance of the process cartridge (image forming station) exceeds 4000 m is shown. Process cartridge usage history and exchange timing depend upon the user and thus the running distance of the disconnected parts within the image forming station is plausible. In such a case, a general combination of the running distance is shown in chart 3. For those that have reached a running distance of over 4000 m the bias is lowered and a higher bias is not used in the image forming stations downstream of the image forming station with the lowered bias. In a tandem structure there is a general tendency to see significant decline in image quality as the number of passes through the station increases; for example, if the color order is K→Y→M→C the tendency of image noise occurring is in that color order. If the next recording medium is recycled paper or if printing on the backside is executed, the color K has the worst image quality and there is a need to lower the first stage transfer bias. Depending upon the combination of the image forming stations, this is not possible with a single power unit but by employing independent power units, even with image forming stations with advanced running distances and comparatively new image forming stations with small running distances mixed, it is possible to sustain high image quality. Also by adjusting the bias to the equivalent of or below that of the upstream station, it is possible to avoid image degradation resulting from transfers through the stations.

CHART 3

| COLOR ORDER | RUNNING DISTANCE | FIRST STAGE TRANSFER BIAS |
|---|---|---|
| K | 4000 m | 600 V |
| Y | 1000 m | 600 V |
| M | 1000 m | 600 V |
| C | 1000 m | 600 V |
| K | 4000 m | 600 V |
| Y | 1000 m | 600 V |
| M | 4000 m | 600 V |
| C | 1000 m | 600 V |
| K | 1000 m | 850 V |
| Y | 1000 m | 850 V |
| M | 4000 m | 600 V |
| C | 4000 m | 600 V |
| K | 1000 m | 850 V |
| Y | 1000 m | 850 V |
| M | 1000 m | 850 V |
| C | 4000 m | 600 V |

Referring first to the write timing of the image support body, as mentioned above, when the first stage transfer bias is changed depending upon the detected paper type of the recording medium, the write timing occurs after the bias value change section (application section of the changed bias, facing section) has passed the exposure section (FIG. 10A). The issue of afterimage related to this also applies to monochrome image forming devices with a single image support body and to color image forming devices with a single first stage transfer power unit as well as with multiple first stage transfer power units for corresponding colors. Therefore in image forming devices able to change the first stage transfer bias depending upon the results of the detected paper type of the recording medium, not limited to a color image forming device with a single transfer power unit, when the first stage transfer bias is changed depending upon the detected paper type of the recording medium, it is preferable for the write timing of the image support body to occur after the changed bias application section has passed the exposure section.

Although the invention has been described with respect to specific embodiment for a complete and clear disclosure, the appended claims are not to be thus limited but are to be construed as embodying all modifications and alternative constructions that may occur to one skilled in the art that fairly fall within the basic teachings herein set forth.

This patent application is based on Japanese Priority Patent Application No. 2007-226216 filed on Aug. 31, 2007, and Japanese Priority Patent Application No. 2007-296602 filed on Nov. 15, 2007, the entire contents of which are hereby incorporated herein by reference.

What is claimed is:

1. An image forming device of a tandem type, comprising:

a power unit that applies a same bias to one or more first stage transfer units;

a detector that detects a type of a recording medium for final image information transfer; and a determining unit that determines a first stage transfer bias based upon a detected type of an initial recording medium and causes the power unit to apply the first stage transfer bias to an intermediate transfer body and causes a toner image from each of one or more image support bodies to be transferred to an intermediate transfer body, wherein the power unit changes the first stage transfer bias after a preceding first stage transfer of a final color toner image is completed when a different type of recording medium than the initial recording medium is detected and successive printing or both-sides printing is executed, and the detector is a paper type detection sensor.

2. The image forming device of claim 1, wherein the power unit applies a lower bias value to the one or more first stage transfer units than the first stage transfer bias for normal paper when the detected type of the recording medium is a rough surface paper.

3. The image forming device of claim 1, wherein the power unit changes the first stage transfer bias for the detected recording medium based on information of an image forming station for each color.

4. The image forming device of claim 1, wherein the power unit changes the first stage transfer bias for the detected recording medium based on information of an image forming station executing the first stage transfer to the intermediate transfer body.

5. The image forming device of claim 3, wherein the power unit changes the first stage transfer bias for the detected recording medium based on information of the image forming station, which is the sum of a running distance of rotating bodies within the image forming station.

6. The image forming device of claim 3, wherein the power unit changes the first stage transfer bias for the detected recording medium based on information of the image forming station, which is a running distance of a development roller within the image forming station.

7. The image forming device of claim 1, wherein the same first stage transfer bias is applied to multiple of the first stage transfer units.

8. The image forming device of claim 2, wherein a range of a surface resistivity of a belt, which is the intermediate transfer body, is $1.00\times10^{7}$~$1.00\times10^{12}$ $\Omega/cm^2$.

9. The image forming device of claim 1, wherein the first stage transfer bias is changed due to the detection of the recording medium after a section of the image support body facing the first stage transfer bias application location has passed an exposure position.

10. The image forming device of claim 1, wherein temporal adjustment is applied when the power unit changes the first stage transfer bias due to the detection of the recording medium.

11. The image forming device of claim 1, wherein the power unit changes the first stage transfer bias for the detected recording medium based on an environment of use.

12. An image forming device, comprising:

a plurality of independent power units that apply a bias to a plurality of first stage transfer units in a plurality of image forming stations;

a detector that detects a type of recording medium for final image information transfer; and a determining unit that determines a first stage transfer bias based upon a detected type of the recording medium and causes the power unit to apply the first stage transfer bias to an intermediate transfer body and causes a toner image from each of multiple image support bodies to be transferred to the intermediate transfer body in a tandem type image forming device, wherein the power units apply an equivalent or lower bias value as the first stage transfer bias to image forming stations located downstream in a conveying direction of the recording medium from one of the image forming stations in which the bias value has been determined to be changed based on detection results of the recording medium and information from an image forming station for each of multiple colors compared to the bias value of the image forming station determined to be changed, and the detector is a paper type detection sensor.

13. An image forming device, comprising:

a detection sensor to detect the type of a recording medium; and a power unit that applies a transfer bias for transfer of a toner image to a transfer body from an image support body, wherein the transfer bias is determined to be changed due to a detection of a different type of recording medium than that of an initial recording medium in a successive printing or both-sides printing operation, the changed transfer bias is applied when a section of an image support body facing the power unit passes an exposure position of writing to the image support body, and the detection sensor is a paper type detection sensor.

14. An image forming device of a tandem type, comprising:

a power unit that applies a same bias to one or more first stage transfer units;

a detector that detects a type of a recording medium for final image information transfer; and a determining unit that determines a first stage transfer bias based upon a detected type of an initial recording medium and causes the power unit to apply the first stage transfer bias to an intermediate transfer body and causes a toner image from each of one or more image support bodies to be transferred to an intermediate transfer body, wherein the power unit changes the first stage transfer bias after a preceding first stage transfer of a final color toner image is completed when a different type of recording medium than the initial recording medium is detected and successive printing or both-sides printing is executed, and the detector detects the recording medium based upon driver information from a user.

15. An image forming device, comprising:

a plurality of independent power units that apply a bias to a plurality of first stage transfer units in a plurality of image forming stations;

a detector that detects a type of recording medium for final image information transfer; and a determining unit that determines a first stage transfer bias based upon a detected type of the recording medium and causes the power unit to apply the first stage transfer bias to an intermediate transfer body and causes a toner image from each of multiple image support bodies to be transferred to the intermediate transfer body in a tandem type image forming device, wherein the power units apply an equivalent or lower bias value as the first stage transfer bias to image forming stations located downstream in a conveying direction of the recording medium from one of the image forming stations in which the bias value has been determined to be changed based on detection results of the recording medium and information from an image forming station for each of multiple colors compared to the bias value of the image forming station determined to be changed, and the detector detects the recording medium based upon driver information from a user.

16. An image forming device, comprising:

a detection sensor to detect the type of a recording medium; and a power unit that applies a transfer bias for transfer of a toner image to a transfer body from an image support body, wherein the transfer bias is determined to be changed due to a detection of a different type of recording medium than that of an initial recording medium in a successive printing or both-sides printing operation, the changed transfer bias is applied when a section of an image support body facing the power unit passes an exposure position of writing to the image support body, and the detection sensor detects the recording medium based upon driver information from a user.

* * * * *